United States Patent [19]

Killen et al.

[11] Patent Number: 4,637,361

[45] Date of Patent: Jan. 20, 1987

[54] NON-ADJUSTABLE THROTTLE POSITION INDICATOR

[75] Inventors: H. Ron Killen, Rochester; Scott A. Wilkins, Royal Oak; Douglas C. Frantz, Berkley, all of Mich.

[73] Assignee: Chrysler Motors Corporation, Highland Park, Mich.

[21] Appl. No.: 824,024

[22] Filed: Jan. 30, 1986

Related U.S. Application Data

[63] Continuation of Ser. No. 620,350, Jun. 13, 1984, abandoned.

[51] Int. Cl.[4] ..... F02M 3/00

[52] U.S. Cl. ..... 123/339; 123/361; 123/350

[58] Field of Search ..... 123/339, 350, 361, 333, 123/335, 396; 73/1 D, 3, 861, 861.02, 861.03

[56] References Cited

U.S. PATENT DOCUMENTS

| | | | |
|---|---|---|---|
| 4,319,658 | 3/1982 | Collonia et al. | 123/350 |
| 4,353,339 | 10/1982 | Collonia | 123/350 |
| 4,484,553 | 11/1984 | Kobayashi et al. | 123/339 |
| 4,506,642 | 3/1985 | Pfalzgraf et al. | 123/361 |
| 4,519,361 | 5/1985 | Murakami | 123/361 |

*Primary Examiner*—Raymond A. Nelli

*Attorney, Agent, or Firm*—Mark P. Calcaterra

[57] ABSTRACT

The need for an accurate measure of the throttle position exists so the electronic engine controller is employed: to continuously check the position of the throttle, to memorize the lowest throttle position reading from the throttle pot, and to define this position as closed throttle. The reading is then updated to compensate for wear in the throttle blade linkages or in the potentiometric device or due to temperature or other conditions. The electronic engine controller will read and retain the lowest measured value of the potentiometric voltage output. This value will then be stored in memory and identified as the closed throttle output until it is necessary to redefine it.

8 Claims, 2 Drawing Figures

NON-ADJUSTABLE THROTTLE POSITION INDICATOR

This application is a continuation of U.S. Ser. No. 620,350 filed on June 13, 1984, now abandoned, having the same title; said case is hereby incorporated by reference.

BACKGROUND AND SUMMARY OF THE INVENTION

Accurate measurement of throttle position is important when using engine control means for automotive applications. Past designs of throttle position indicators include two-position throttle switches and various potentiometric devices.

The two-position throttle switch provides an electrical signal to the engine control means when the throttle is in one of two positions: typically closed and wide open. These switches require service after a period of use as exposure to an automotive environment may cause the deterioration of the materials in the switch. Service or replacement of the switch would eventually be necessary in order to provide the electronic engine controls with an accurate indication of the throttle position.

Another throttle position indicator which has been used is a potentiometric device. This is also known as a throttle pot. The throttle pots are mounted on the exterior of the throttle body or carburetor and are connected to the throttle blade linkage in such a fashion so as to deflect the wiper arm of the throttle pot in proportion to the movement of the throttle blade. The potentiometric location of the closed throttle position and the wide open throttle position is established during the assembly process. This is done by mechanically mounting the throttle pot with the wiper arm in a pre-established location with respect to the fully closed position of the throttle blade. The throttle pot then provides readings to the engine control means, all referenced to the mechanically set base line, which is usually the closed throttle position. The accuracy of the adjustable throttle pot is in direct proportion to the skill of the assembler and to the integrity of the mechanical fastening means holding the throttle pot to the throttle body. Eventually, the adjustable throttle pot may need service to account for wear in the throttle blade linkage and possible deterioration of the potentiometer.

The subject invention seeks to eliminate the need for mechanical adjustment of the throttle pot during the assembly process and also seeks to eliminate the need for service adjustments on the adjustable throttle pot due to throttle body linkage wear.

This is accomplished by using a conventional throttle potentiometer with a modified mounting mechanism which is nonadjustable. In other words, the assembler will need only to affix the throttle pot to the throttle body at the designated location and insert the appropriate mounting devices, such as screws, through fixed guiding means. The assembly can then be completed without the need of any adjustments or decisions to be made by the assembler.

The need for an accurate measure of the throttle position still exists so the engine control means is now employed: to continuously check the position of the throttle, to memorize the lowest throttle position reading from the throttle pot, and to define this position as closed throttle. The reading is then updated to compensate for wear in the throttle blade linkages or in the potentiometric device or due to temperature or other conditions. The engine control means will read and retain the lowest measured value of the potentiometric voltage output. This value will then be stored in memory and identified as the closed throttle output until it is necessary to redefine it.

Additional features of measuring the throttle position in the above-described manner include: the prohibition of false readings due to low cranking voltages; the establishment of a default value upon the reset of memory (usually due to the disconnection of the battery); the ability to reset (a default condition) if no closed throttle indication occurs between two sequential cranking events.

DESCRIPTION OF THE DRAWINGS

Other objects, features and advantages of the present invention will become more fully apparent from the following detailed description of the preferred embodiment, the appended claims and in the accompanying drawings in which:

DETAILED DESCRIPTION OF THE PREFERRED EMBODIMENT

Figure 1:
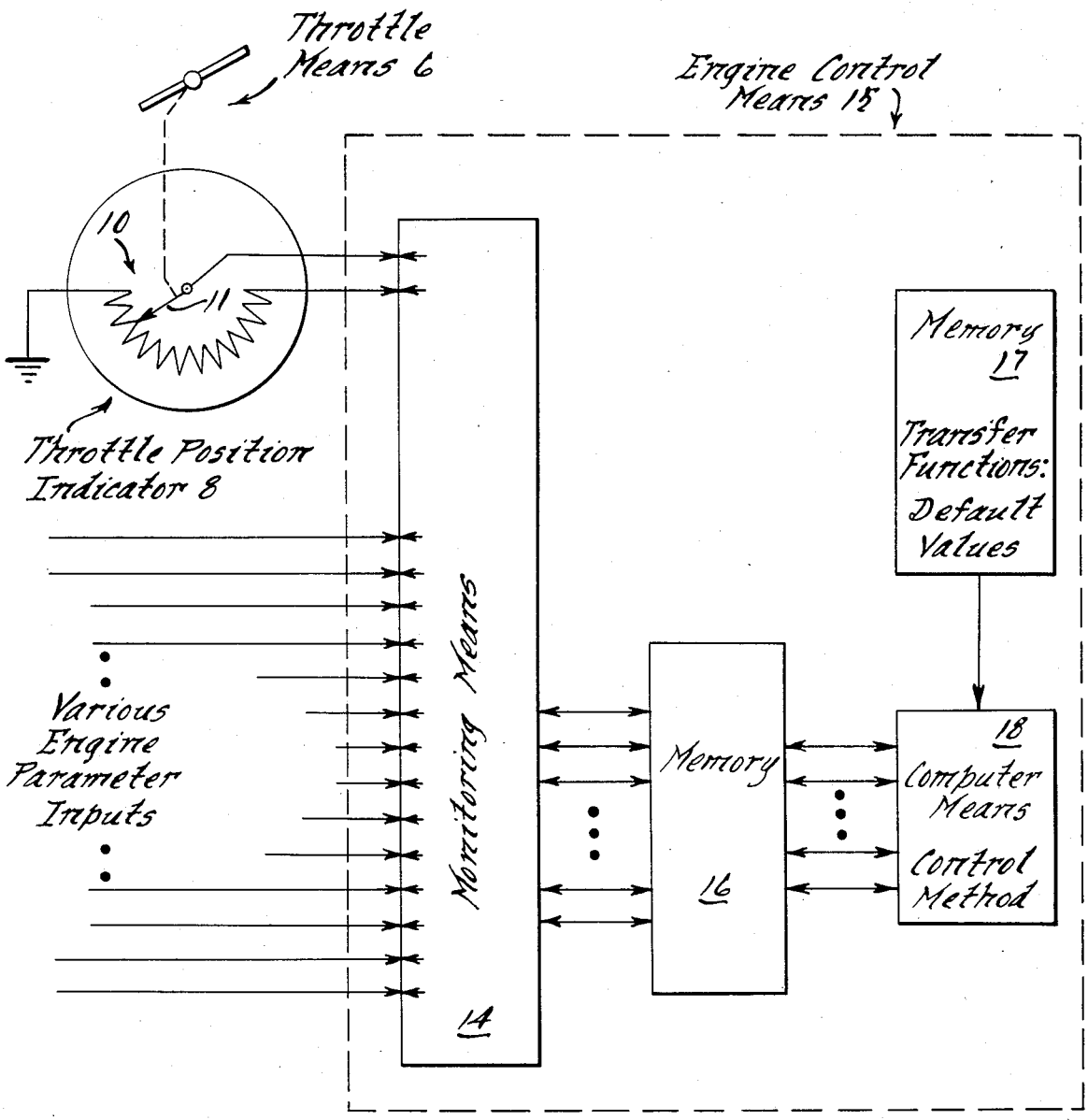
FIG. 1 is a block diagram of an exemplar engine control means and its relationship to a throttle and throttle position indicator.
Figure 2:
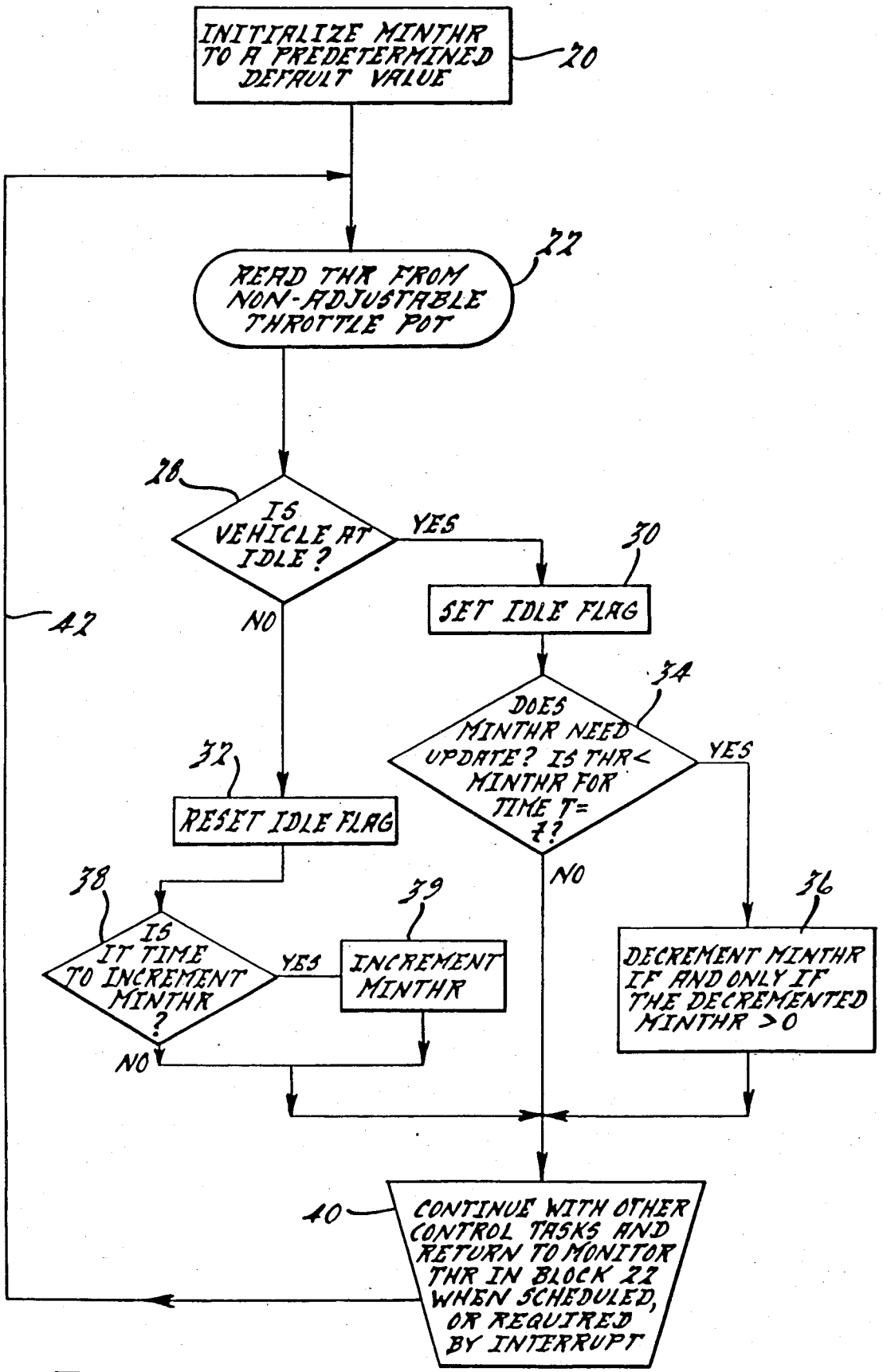
FIG. 2 is a flowchart illustrating each of the components and steps to the nonadjustable throttle position indicator described herein.

Referring to FIG. 1 which illustrates the structure involved with the Non-Adjustable Throttle Position Indicator, the structure shown in FIG. 1 is merely an exemplar of what an automotive engineer uses to practice the methods described in FIG. 2.

Other exemplars are included in U.S. Pat. No. 4,335,689 by Abe et al. dated June 22, 1982 entitled "Electronic Type Air/Fuel Ratio Control System"; U.S. Pat. No. 4,508,078 by Takeuchi et al. dated Apr. 2, 1985, entitled "Electrically Operated Engine Throttle Valve Acuating Device"; and U.S. Pat. No. 4,492,211 by Shimomura et al. dated Jan. 8, 1985, entitled "Air-To-Fuel Ratio Control System For Internal Combustion Engine". These patents are hereby incorporated by reference.

In a vehicle with an engine (not shown) employing a throttle means 6 to control the flow of fuel to the engine, thereby controlling its speed and thusly the power of the vehicle, the throttle means 6 is connected to a throttle position indicator 8.

Throttle position indicator 8, in this particular embodiment, comprises a potentiometer 10 with a wiper arm 11. Action of the throttle means 6 results in correlative action of the wiper arm 11 thereby indicating an electrical signal coming out from the indicator 8. As the throttle means 6 changes its angular position, so does the position of the wiper arm 11 change thereby producing a different electrical signal. In the particular embodiment shown the electrical signal consists of a resistance reading typical of a potentiometer.

Also shown in FIG. 1 is engine control means 15 to which throttle position indicator 8 is connected. Within the engine control means 15, there exists monitoring means 14, memory 16, memory 17 and computer means 18.

Various engine parameter inputs from other types of indicators and sensors analogous to the throttle position indicator 8 present their signals to the monitoring means 14 which is designed to condition the signals from the various engine parameter sensors (not shown) and place them in a condition to be used by the other parts of the engine control means 15.

The various engine parameter signals, along with the throttle position indicator signal, after being buffered in monitoring means 14, are presented to the memory 16 for short term storage. The values are called up by the computer means 18 and used along with default values if necessary and in transfer functions both stored in memory 17, where required by the computer means 18.

The computer means 18 uses the control method illustrated in FIG. 2 to analyze the data from the various engine parameters, including the throttle position indicator and to make decisions based on the data values and to send information back to the transducers for each parameter through the memory 16 and monitoring means 14.

This control method eliminates the need to mechanically adjust the throttle position indicator 8 at a "zero" or reference location corresponding to a particular position of the throttle means 6.

The control method determines the reference position. The use of this method prevents the need to readjust the throttle position indicator 8 as it wears. Wear and temperature changes cause the electrical signal output of the indicator 8 to change. Since the method constantly hunts and redefines the reference location of wide open throttle or closed throttle (a design choice), the system is less affected by the environment and wear.

Referring to FIG. 2 which outlines the method described herein and how it interfaces with the structure of the engine control means, the throttle means and the nonadjustable throttle position indicator, a variable MINTHR is initialized to a predetermined default value in 20. MINTHR represents the minimum throttle angle position of the throttle means and in the preferred embodiment is a voltage level.

The default value of MINTHR is started from a predetermined value which is stored in the memory 17 of the engine control means 15. This value is artificially high and is only utilized in the initialization block 20 when the vehicle's battery is disconnected or the vehicle's throttle position indicator is changed. Otherwise, the variable MINTHR does not need initialization and has a value equal to that determined when the vehicle was last in use; it is stored in memory 16 of the engine control means 15.

The rest of the throttle position indicator system and method is employed after the initialization or after the vehicle is restarted as determined by a schedule of events and interrupts in the engine control means 15.

After initialization of MINTHR or upon command or interrupt from the control system, the actual throttle position THR is sensed by monitoring a voltage presented by the nonadjustable throttle position indicator 8 which is mounted to the linkage of the throttle means 6. A movement of the throttle means 6 or blade due to the linkage with the wiper arm 11 of the throttle position indicator 8, creates a signal from the throttle position indicator 8 which is proportional to the position of the throttle means 6. This signal is usually a voltage level and can be stored in the engine control means 15 or other computer means for later use.

Once the THR signal is read in block 22, a determination is made by the engine control means 15 to check whether the vehicle is at idle. This is done in block 28. It can be seen that at this point the minimum throttle position MINTHR can be equal to one of two different values: the default value from memory 17 or the previously stored value for MINTHR in memory 16.

Once the determination is made that the vehicle is or is not at idle in block 28, the engine control means 15 sets an idle flag if the vehicle is at idle in block 30 or resets an idle flag in block 32 if the vehicle is not at idle. The idle flag represents a connection to the other segments of the engine control means and provides the condition of the idle flag to other segments of the control means as needed, as well as a connection to sample various other parameters such as the vehicle speed, engine RPM, the condition of the brake switch, and the manifold absolute pressure (MAP), etc. The subject throttle position indicator and method utilizes these other factors along with the signals from the throttle pot and the decisions described herein to decide whether the vehicle is in a true idle condition. For example, idle is a condition determined when several factors exist. One of those factors is the condition when the throttle position THR is less than or equal to the minimum throttle position, MINTHR, plus a variable lambda where lambda is a function of the various hystereses involved in all of the components of the system.

Returning now to block 30, which represents the condition where the vehicle is at idle and a value for MINTHR has been stored, we proceed to block 34 for another comparison. The subject comparison determines whether the minimum throttle position MINTHR needs updating. This is done by comparing the actual throttle position THR with the minimum throttle position MINTHR. If THR is less than MINTHR for an appropriate time period $T=t$, then the minimum throttle needs updating and proceeds to block 36.

Block 36 takes advantage of a previously determined throttle position decrement amount. This decrement amount is employed if and only if the value of MINTHR after decrementing is greater than zero. This is done to keep the value of MINTHR from slipping below zero.

Following a reset of the idle flag in block 32, a form of fine adjustment to MINTHR can take place. It is a positive pressure feature described in blocks 38 and 39 which will take advantage of a predetermined increment amount of throttle position. Since an increment is not always needed, a decision is made in block 38 whether to increment MINTHR. An example of the type of analysis performed in block 38 is to apply the increment amount to the minimum throttle position MINTHR once every time the vehicle has a rapid deceleration. The increment is performed in block 39 if needed. This positive pressure on the MINTHR value is necessary due to the hysteresis of the potentiometer or of any linkages in the throttle means and helps to deal with the situation where idle may not always occur at the same physical location of the throttle blade. The predetermined default value for minimum acceptable throttle position acts as an upper limit for the positive pressure.

Regardless of whether the MINTHR value has passed through blocks 34, 36 or 38, it will then proceed to bubble 40 releasing the engine control means 15 to perform other tasks and to return to resense the actual throttle position THR when next scheduled or upon demand or interrupt as required by other factors. The return path will be similar to that shown in FIG. 2 as 42 and will begin with block 22 to read the throttle position THR unless an event, such as the disconnection of the battery or throttle position indicator 8 has occurred. In which case, the initialization block 20 will be selected by the engine control means 15 as the starting point of the throttle position indication system and method described herein.

When it is time to resense the throttle position THR, the method follows path 42 and is repeated beginning with block 22.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

We claim:

1. In a vehicle having an engine with a throttle means to regulate flow of combustible elements into the engine, engine control means, means for monitoring and storing various engine parameters and other data and means for storing predetermined values and default values and transfer functions, a throttle position indicator with a variable electrical output in communication with the throttle means such that movement of the throttle means translates to a change in the variable electrical output of the indicator, and stored values of predetermined data and values, including default values for minimum acceptable throttle position, tolerance values for acceptable minimum throttle position, increment and decrement amounts for changing the minimum acceptable throttle position values, a method for indicating throttle position comprising:

sensing the actual throttle position as a function of the electrical output of the indicator;

defining a predetermined default value as the minimum acceptable throttle position value;

determining whether the vehicle is at idle and storing the determination;

comparing the actual throttle position to the minimum acceptable throttle position value to decide whether to update the minimum acceptable throttle position value; and if and only if the vehicle is at idle and if the minimum acceptable throttle position value needs updating, reducing, by a predetermined decrement amount, the minimum acceptable throttle position value if and only if the minimum acceptable throttle position value would be greater than zero after reducing.

2. The method of indicating throttle position of claim 1 further comprising:

increasing, by a predetermined increment amount, the minimum acceptable throttle position value if and only if the vehicle's engine is not at idle.

3. The method of indicating throttle position of claim 1 further comprising:

increasing, by a predetermined increment amount, the minimum acceptable throttle position value, if and only if the vehicle's engine is not at idle, if and only if it is less than or equal to the predetermined default value for minimum acceptable throttle position.

4. The method of indicating throttle position of claim 1 further comprising:

increasing, by a predetermined increment amount, the minimum acceptable throttle position value if and only if the vehicle's engine is not at idle, whereby positive pressure is placed on the minimum acceptable throttle position value to compensate for different throttle blade locations at idle due to hysteresis wear and temperature in throttle means linkages and in the throttle position indicator.

5. The method of indicating throttle position of claim 1 further comprising:

increasing, by a predetermined increment amount, the minimum acceptable throttle position value if and only if the vehicle's engine is not at idle, if and only if it is less than or equal to the predetermined default value for minimum acceptable throttle position whereby positive pressure is placed on the minimum acceptable throttle position value to compensate for different throttle blade locations at idle due to hysteresis wear and temperature in throttle means linkages and in the throttle position indicator.

6. The method of indicating throttle position of claim 1 further comprising:

resensing the actual throttle position according to a predetermined transfer function and repeating the method thereafter.

7. The method of indicating throttle position of claim 2 further comprising:

resensing the actual throttle position according to a predetermined transfer function and repeating the method thereafter.

8. The method of indicating throttle position of claim 3 further comprising:

resensing the actual throttle position according to a predetermined transfer function and repeating the method thereafter.

* * * * *